US012018354B2

(12) United States Patent
Vo et al.

(10) Patent No.: US 12,018,354 B2
(45) Date of Patent: Jun. 25, 2024

(54) HIGH-PERFORMANCE 3000-SERIES ALUMINUM ALLOYS

(71) Applicant: NanoAL LLC, Ashland, MA (US)

(72) Inventors: Nhon Q. Vo, Winchester, MA (US); Evander Ramos, Los Angeles, CA (US); Davaadorj Bayansan, Glenview, IL (US); Francisco U. Flores, Lowell, MA (US)

(73) Assignee: NanoAL LLC, Ashland, MA (US)

( * ) Notice: Subject to any disclaimer, the term of this patent is extended or adjusted under 35 U.S.C. 154(b) by 999 days.

(21) Appl. No.: 16/562,968

(22) Filed: Sep. 6, 2019

(65) Prior Publication Data

US 2019/0390312 A1 Dec. 26, 2019

Related U.S. Application Data

(63) Continuation of application No. PCT/US2018/020893, filed on Mar. 5, 2018.

(60) Provisional application No. 62/468,461, filed on Mar. 8, 2017.

(51) Int. Cl.
*C22F 1/047* (2006.01)

(52) U.S. Cl.
CPC ..... *C22F 1/047* (2013.01)

(58) Field of Classification Search
CPC ..... C22F 1/047
See application file for complete search history.

(56) References Cited

U.S. PATENT DOCUMENTS

| | | | |
|---|---|---|---|
| 3,551,143 | A | 12/1970 | Marukawa et al. |
| 3,807,969 | A | 4/1974 | Schoerner et al. |
| 5,087,301 | A | 2/1992 | Angers et al. |
| 5,327,955 | A | 7/1994 | Easwaran |
| 5,449,421 | A | 9/1995 | Hamajima et al. |
| 5,976,214 | A | 11/1999 | Kondoh et al. |
| 6,149,737 | A | 11/2000 | Hattori et al. |
| 6,592,687 | B1 | 7/2003 | Lee et al. |
| 6,918,970 | B2 | 7/2005 | Lee et al. |
| 8,323,373 | B2 | 12/2012 | Haynes, III et al. |
| 8,778,099 | B2 | 7/2014 | Pandey |
| 9,453,272 | B2 | 9/2016 | Vo et al. |
| 2003/0192627 | A1 | 10/2003 | Lee et al. |
| 2006/0260723 | A1 | 11/2006 | Sylvain |
| 2009/0263275 | A1 | 10/2009 | Pandey |
| 2010/0143177 | A1 | 6/2010 | Pandey et al. |

(Continued)

FOREIGN PATENT DOCUMENTS

| | | |
|---|---|---|
| CN | 103233147 A | 8/2013 |
| CN | 104364409 A | 2/2015 |

(Continued)

OTHER PUBLICATIONS

First Office Action dated Dec. 7, 2020 for Chinese Application No. 201880025151.9, with English translation, 13 pages.

(Continued)

*Primary Examiner* — Anthony M Liang
*Assistant Examiner* — Danny N Kang
(74) *Attorney, Agent, or Firm* — COOLEY LLP

(57) ABSTRACT

Aluminum-manganese-zirconium-inoculant alloys that exhibit high strength, high ductility, high creep resistance, high thermal stability, and durability, and can be fabricated utilizing recycled used aluminum cans.

33 Claims, 6 Drawing Sheets

(56) References Cited

U.S. PATENT DOCUMENTS

| | | | | |
|---|---|---|---|---|
| 2011/0017359 | A1 | 1/2011 | Pandey | |
| 2012/0000578 | A1 | 1/2012 | Wang et al. | |
| 2013/0183189 | A1 | 7/2013 | Bishop et al. | |
| 2013/0199680 | A1 | 8/2013 | Apelian et al. | |
| 2013/0220497 | A1 | 8/2013 | Huskamp et al. | |
| 2013/0334091 | A1 | 12/2013 | Sawtell et al. | |
| 2016/0201168 | A1* | 7/2016 | Shishido | C21D 1/18 148/439 |
| 2016/0305000 | A1 | 10/2016 | Aruga et al. | |
| 2017/0058386 | A1 | 3/2017 | Vo et al. | |

FOREIGN PATENT DOCUMENTS

| | | | |
|---|---|---|---|
| CN | 105074028 | A | 11/2015 |
| CN | 105829559 | A | 8/2016 |
| EP | 0 558 957 | A2 | 9/1993 |
| EP | 2 241 644 | A1 | 10/2010 |
| JP | H08232035 | A | 9/1996 |
| JP | 08-296011 | A | 11/1996 |
| JP | H08291377 | A | 11/1996 |
| JP | 2002-256403 | A | 9/2002 |
| JP | 2016505713 | A | 2/2016 |
| KR | 10-2015-0023006 | A | 3/2015 |
| WO | WO 2005/045080 | A1 | 5/2005 |
| WO | WO-2008114680 | A1 | 9/2008 |
| WO | WO-2014088449 | A1 | 6/2014 |

OTHER PUBLICATIONS

Final Office Action dated Feb. 24, 2021 for U.S. Appl. No. 15/263,011, 7 pages.
Second Office Action dated Jun. 30, 2021 for Chinese Application No. 201880025151.9, with English translation, 11 pages.
Communication Pursuant to Article 94(3) EPC dated Jul. 6, 2021 for European Application No. 18763093.4, 4 pages.
Non-Final Office Action dated May 4, 2016 for U.S. Appl. No. 14/645,654, 8 pages.
Non-Final Office Action dated Dec. 31, 2018 for U.S. Appl. No. 15/263,011, 5 pages.
Final Office Action dated Aug. 8, 2019 for U.S. Appl. No. 15/263,011, 7 pages.
Extended European Search Report dated Feb. 15, 2017 for European Application No. 15760733.4, 9 pages.
Extended European Search Report dated Sep. 23, 2019 for European Application No. 19172652.0, 8 pages.
International Search Report and Written Opinion dated Jun. 25, 2016 for International Application No. PCT/US2015/020218, 14 pages.
International Search Report and Written Opinion dated Jun. 18, 2018 for International Application No. PCT/US2018/020893, 10 pages.
Berezina, A. L. et al., "Decomposition Processes in the Anomalous Supersaturated Solid Solution of Binary and Ternary Aluminum Alloys Alloyed with Sc and Zr," Acta Physica Polonica A, 122(3):539-543 (2011).
Booth-Morrison, C. et al., "Effect of Er additions on ambient and high-temperature strength of precipitation-strengthened Al—Zr—Sc—Si alloys," Acta Mater, 60:3463-3654 (2012).
Booth-Morrison, C. et al., "Role of silicon in accelerating the nucleation of $Al_3$(Sc,Zr) precipitates in dilute Al—Sc—Zr alloys," Acta Mater, 60:4740-4752 (2012).
Booth-Morrison, C. et al., "Coarsening resistance at 400° C. of precipitation-strengthened AlZrScEr Alloys," Acta Mater, 59(18):7029-7042 (2011).
Fuller, C. B. et al., "Temporal evolution of the nanostructure of Al(Sc,Zr) alloys: Part 1—Chemical compositions of $Al_3(SC_{1-x}Zr_x)$ precipitates," Acta Mater, 53:5401-5413 (2005).
Hallem, H. et al., "The formation of $Al_3(Sc_xZryHf_{1-x-y})$ dispersoids in aluminum alloys," Mater Sci Eng A, 421:154-160 (2006).
Hori, S. et al., "Effect of small addition of Si on the precipitation of Al-0.6%Zr Alloys," J Jpn Inst Light Met, 28:79-84 (1978).
Huang, H. et al., "Age Hardening Behavior and Corresponding Microstructure of Dilute Al—Er—Zr Alloys," Metallurgical and Materials Transactions A, 44A:2849-2856 (2013).
Knipling, K. E. et al., "Criteria for developing castable, creep-resistant aluminum-based alloys—A Review," Z Metallkd, 97:246-265 (2006).
Knipling, K. E. et al., "Atom Probe Tomographic Studies of Precipitation in Al—0.1Zr—0.1Ti (at.%) Alloys," Microscopy and Microanalysis, 13:1-14 (2007).
Knipling, K. E. et al., "Nucleation and Precipitation Strengthening in Dilute Al—Ti and Al—Zr Alloys," Metallurgical and Materials Transactions A, 38A:2552-2563 (2007).
Knipling, K. E. et al., "Creep resistance of cast and aged Al—0.1Zr and Al—0.1Zr—0.1Ti (at.%) alloys at 300-400° C.," Scr Mater, 59:387-390 (2008).
Knipling, K. E. et al., "Precipitation evolution in Al—Zr and Al—Zr—Ti alloys during isothermal aging at 375-425° C.," Acta Mater, 56:114-127 (2008).
Knipling, K. E. et al., "Precipitation evolution in Al—Zr and Al—Zr—Ti alloys during isothermal aging at 450-600° C.," Acta Mater, 56:1182-1195 (2008).
Knipling, K. E. et al., "Precipitation evolution in Al—0.1Sc, Al—0.1Zr and Al—0.1Sc—0.1Zr (at.%) alloys during isochronal aging," Acta Mater, 58:5184-5195 (2010).
Knipling, K. E. et al., "Ambient- and high-temperature mechanical properties of isochronally aged Al—0.06Sc, Al—0.06Zr and Al—0.06Sc—0.06Zr (at.%) alloys," Acta Mater, 59:943-954 (2011).
LeClaire, A. D. et al., "3.2.13 Aluminum group metals," Diffusion in Solid Metals and Alloys (H. Mehrer (Ed.), Springer Materials—Landolt-Bornstein—Group III condensed Matter, 26:151-156 (1990).
Li, H. et al., "Precipitation and evolution and coarsening resistance at 400° C. of Al microalloyed with Zr and Er," Scr Mater, 67:73-76 (2012).
Ohashi, T. et al., "Effect of Fe and Si on age hardening properties of supersaturated solid solution of Al—Zr," J Jpn. Inst Met, 34:604-640 (1970).
Riddle, Y. W. et al., "A Study of Coarsening, Recrystallization, and Morphology of Microstructure in Al—Sc—(Zr)—(Mg) Alloys," Metallurgical and Materials Transactions A, 35A:341-350 (2004).
Sato, T. et al., "Effects of Si and Ti Additions on the Nucleation and Phase Stability of the $L1_2$-Type $Al_3Zr$ Phase in Al—Zr Alloys," Mater Sci Forum, 217-222:895-900 (1996).
Seidman, D. N. et al., "Precipitation strengthening at ambient and elevated temperatures of heat-treatable Al(Sc) alloys," Acta Mater, 50:4021-4035 (2002).
Van Dalen, M. E. et al., "Effects of Ti additions on the nanostructure and creep properties of precipitation-strengthened Al—Sc alloys," Acta Mater, 53:4225-4235 (2005).
Wen, S. P. et al., "Synergetic effect of Er and Zr on the precipitation hardening of Al—Er—Zr alloy," Scr Mater, 65:592-595 (2011).
Zhang, Y. et al., "Precipitation evolution of Al—Zr—Yb alloys during isochronal aging," Scr Mater, 69:477-480 (2013).
Non-Final Office Action dated Jun. 26, 2020 for U.S. Appl. No. 15/263,011, 7 pages.
Extended European Search Report dated Sep. 21, 2020 for European Application No. 18763093.4, 5 pages.
Non-Final Office Action dated Dec. 21, 2021 for U.S. Appl. No. 15/263,011, 7 pages.
Notice of Reasons for Rejection dated Mar. 2, 2022 for Japanese Application No. 2019-548309, with English translation, 13 pages.
Office Action dated Aug. 13, 2021 for Korean Application No. 10-2016-7028392, with English translation, 14 pages.
Office Action for Japanese Application No. JP20190548309 dated Dec. 15, 2022, 8 pages.

* cited by examiner

HIGH-PERFORMANCE 3000-SERIES ALUMINUM ALLOYS

This application is a continuation of International Patent Application No. PCT/US2018/020893, filed Mar. 5, 2018, and titled High-Performance 3000-Series Aluminum Alloys, which claims the benefit of and priority to U.S. Provisional Patent Application No. 62/468,461, filed Mar. 8, 2017, and titled High-Performance 3000-Series Aluminum Alloys, the contents of each of which are incorporated herein by reference in their entirety.

This invention was made with government support under Federal Award No. IIP 1549282, awarded by National Science Foundation. The Government has certain rights in the invention.

FIELD

This application relates to a family of 3000-series aluminum alloys with high strength, high ductility, high creep resistance, high thermal stability and durability. The disclosed alloys are especially advantageous for, but not limited to, improving performance of beverage and aerosol cans. Additionally, the disclosed alloys are, for example, advantageous for improving performance of roofing and siding materials, chemical and food equipment, storage tanks, pressure vessels, home appliances, kitchenware, sheet-metal work, truck and trailer parts, automotive parts, and heat exchangers.

BACKGROUND

The production of aluminum cans, largely to store beverages, is the single largest usage of aluminum in the world. The annual production is a staggering 320 billion cans per year, equating to 4.16 billion kilograms of aluminum. In addition, aluminum canning is likely the world's best example of recycling, as 75% of the aluminum used in cans is recycled. The production of aluminum cans is enormous, so an efficiency improvement comes with a giant multiplicative effect; a single gram of weight saved in the can may save over 200 thousand metric tons of aluminum globally per year. Together with this weight benefit, the energy consumption as well as the $CO_2$ emissions during transport are reduced—both key metrics in sustainability of the environment. Additionally, the lightness of aluminum cans helps save resources during filling, storage, transportation and scrap at the end of the product's life. Thus lightweighting the can has been a front-burner issue for decades.

The beverage packaging industry is constantly seeking ways to maintain the can's performance while continuing to trim the materials as much as possible. A common can design consists of two pieces: the can body is made of 3000-series aluminum, specifically AA3004, while the can lid and opener are made from 5000-series aluminum, specifically AA5182. The success behind the consistent and precise production of aluminum cans is based on the strong yet formable 3000- and 5000-series aluminum sheets. The can body is about 75% of the can's mass, while the smaller lid claims the rest, 25%. Two most obvious ways to design a lighter can are: (i) designing a smaller lid and (ii) reducing thickness of the can's wall and lid. In order to thin the can body and lid, stronger 3000-series and 5000-series alloys are needed, while maintaining important characteristics, such as density, formability and corrosion resistance. Aerospace-grade 2000- and 7000-series are very strong, but their low formability is not suitable for canning. Thus the common approach to develop new canning materials is to modify the currently utilized alloys, that is, modifying alloy composition and thermo-mechanical processes to the current 3000-series and 5000-series alloys to strengthen them without sacrificing other important properties. Moreover, 75% of the aluminum in cans is recycled and is currently being used to recast aluminum sheets, which are returned to can manufacturers to produce new batches of cans. Recycling plays a significant role in the economics of canning, thus modifying the current 3000-series and 5000-series alloys will help maintain the usage of low-cost recycled cans.

A well-known means to enhance the strength and maintain the ductility of commercial aluminum alloys is the addition of small concentrations of Scandium (Sc). The strengthening originates from the creation during aging of $L1_2$-structured $Al_3Sc$ nano-precipitates (~5-10 nm in diam.) which are coherent with the aluminum matrix. The small volume fraction, nano-size and matrix coherency of these precipitates help the alloys maintain other properties, such as ductility and formability. Scandium, however, is extremely costly (ten-fold more expensive than silver), severely prohibiting its usage in cost-sensitive applications such as food and drink packaging.

Accordingly, stronger 3000-series aluminum alloys are needed, while maintaining important characteristics, such as density, formability and corrosion resistance. With a stronger material, the can's wall can be made thinner, resulting in a lighter beverage can.

SUMMARY

The embodiments described herein relate to heat-treatable aluminum-manganese-based (3000-series) alloys, containing an $Al_3Zr$ nanoscale precipitate, wherein the nanoscale precipitate has an average diameter of about 20 nm or less and has an $L1_2$ structure in an α-Al face centered cubic matrix, wherein the average number density of the nanoscale precipitate is about $20^{21}$ $m^{-3}$ or more. They exhibit high strength, high ductility, high creep resistance, high thermal stability and durability, while being essentially free of scandium (i.e., no scandium is added intentionally). In some embodiments, the alloys are heat and creep resistant at temperatures as high as 400° C. In some embodiments, the alloys can be fabricated utilizing recycled used aluminum cans.

Figure 4:
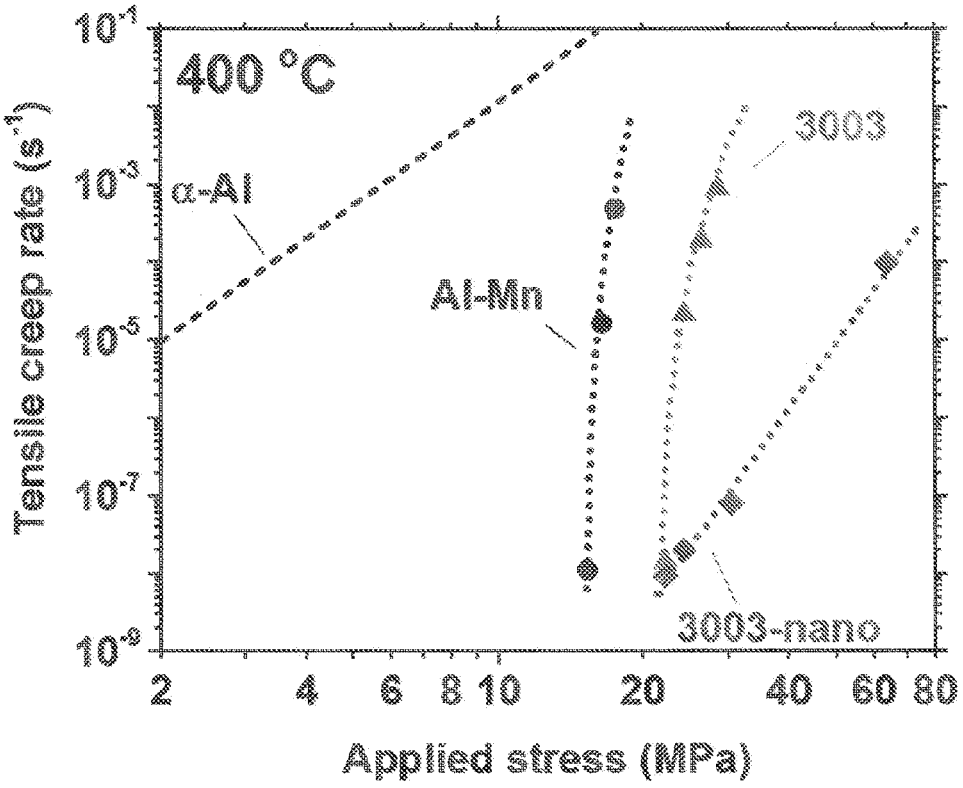

FIG. 4: Tensile creep rate versus applied stress of Al-1.2Mn wt. % (Al—Mn), Al-1.2Mn-0.12Cu-0.7Fe-0.5Si wt. % (3003), and Al-1.2Mn-0.12Cu-0.7Fe-0.5Si-0.3Zr-0.1Sn wt. % (3003-nano) (invented alloy) alloys at 400° C.

Figure 5:
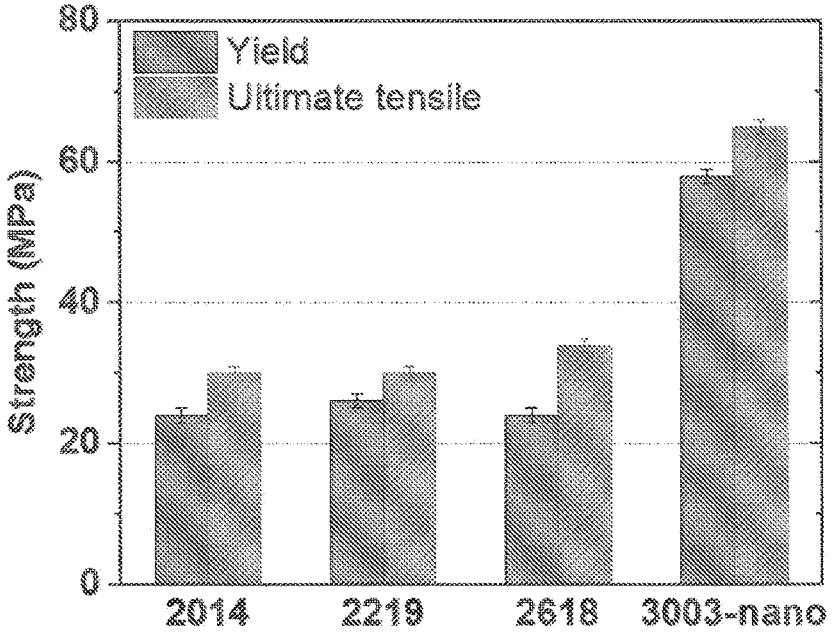

FIG. 5: Tensile strength at elevated temperature (400° C.) of Al-1.2Mn-0.12Cu-0.7Fe-0.5Si-0.3Zr-0.1Sn wt. % (3003-nano) (invented alloy) alloy, compared to the commercial 2000-series aluminum alloys (all T6-temper) used in light-weight, high-temperature structural applications.

Figure 6:
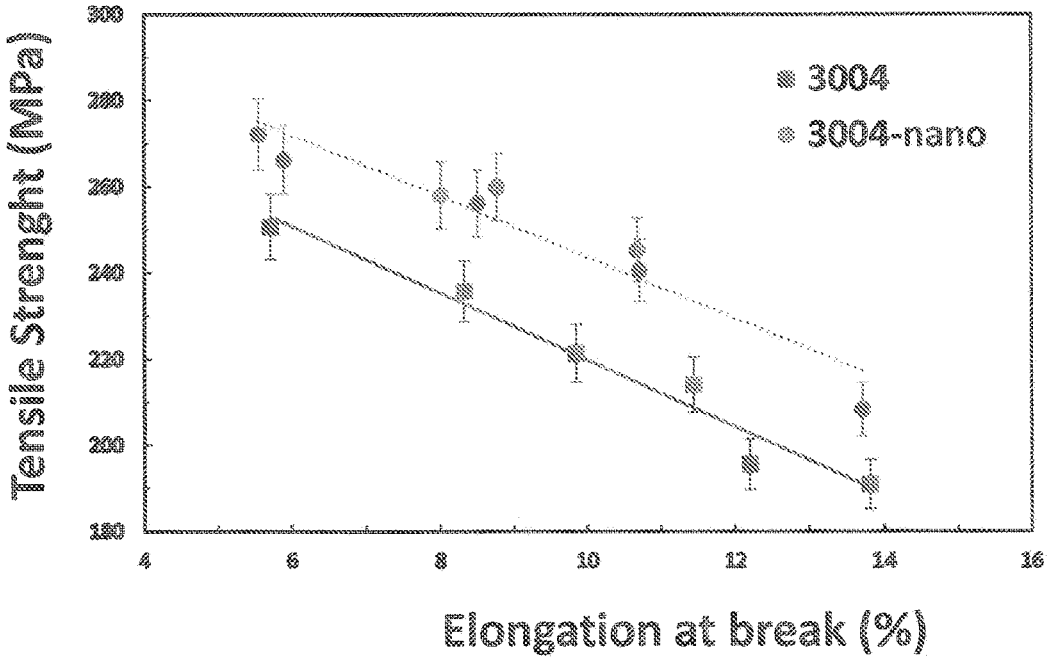

FIG. 6: Tensile strength versus elongation at break of Al-1.0Mn-1.0Mg-0.15Cu-0.5Fc-0.2Si wt. % (AA3004) (example alloy), and Al-1.0Mn-1.0Mg-0.15Cu-0.5Fe-0.2Si-0.3Zr-0.1Sn wt. % (AA3004-nano) (invented alloy), fabricated by the following steps: casting, hot-rolling, cold-rolling, and heat aging treatment at temperatures in the range of about 350° C. to about 450° C. for times in the range of about 2 to about 24 hours.

DETAILED DESCRIPTION

Figure 1A:
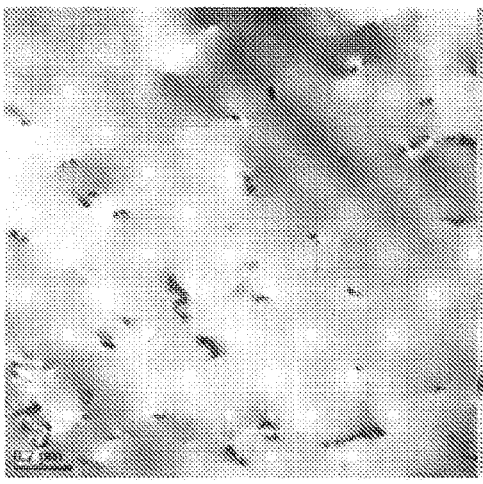
FIGS. 1A-1D: Bright field two-beam transmission electron microscopy images of (A) Al-1.2Mn wt. % showing $Al_6Mn$ precipitates, (B) Al-1.2Mn-0.12Cu-0.7Fe-0.5Si wt. % (AA3003) showing α-Al(Mn,Fe)Si precipitates, (C) Al-1.2Mn-0.12Cu-0.7Fe-0.5Si-0.3Zr-0.1Sn wt. % (invented alloy) showing Al(Mn,Fe)Si and $L1_2$-$Al_3Zr$ nano-precipitates, and (D) a highly magnified image of a portion of FIG. 1C.
Figure 1B:
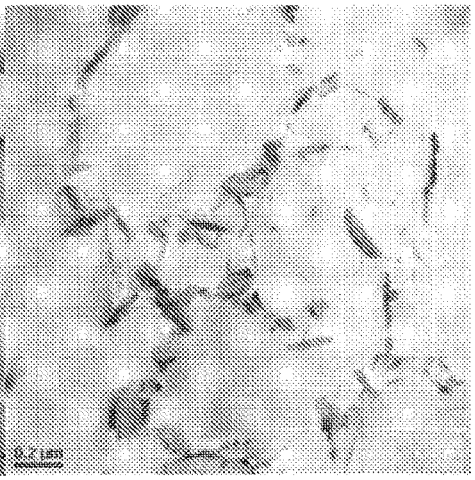
Figure 1C:
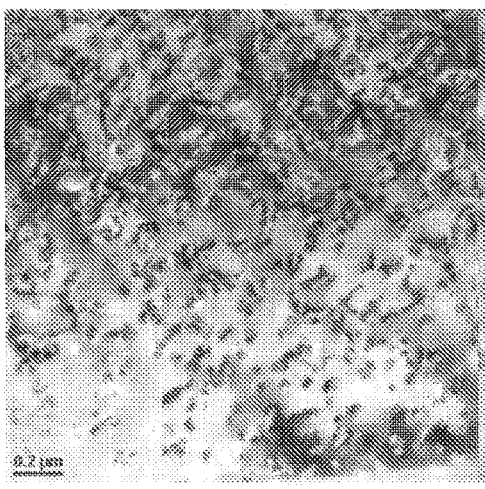
Figure 1D:
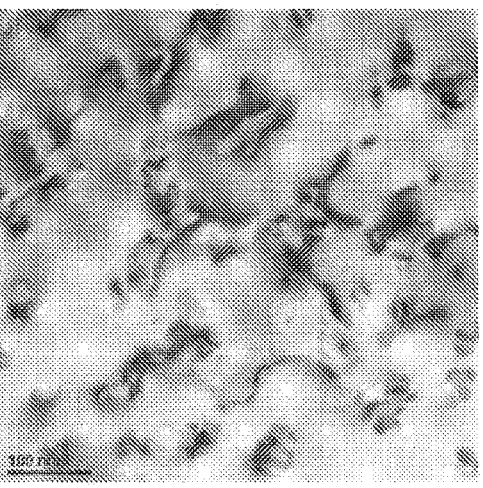

AA3003 aluminum alloy is the most basic alloy in the 3000-series, containing 1-1.5 Mn, 0.05-0.2 Cu, ≤0.7 Fe and ≤0.5 Si as impurities, and <0.05 each of any other impurity (wt. %). Manganese, which is the main alloying element in 3000-series aluminum alloys, increases strength either in solid solution or as a fine intermetallic phase. The effect of the maximally allowed Fe and Si concentrations as well as $Al_3Zr$ nano-precipitates on the performance of this basic alloy was investigated. It is noted that the small existing Cu concentration is known to not affect mechanical properties of AA3003 alloy. Nanostructure of three studied alloys, i.e. Al-1.2Mn, Al-1.2Mn-0.12Cu-0.7Fe-0.5Si, and Al-1.2Mn-0.12Cu-0.7Fe-0.5Si-0.3Zr-0.1Sn (wt. %), is displayed in FIGS. 1A-1D. Typical $Al_6Mn$ precipitates, having a relatively low number density, were mainly observed in the Al-1.2Mn alloy, FIG. 1A, α-Al(Mn,Fe)Si precipitates, with an hexagonal structure, were mainly observed in the Al-1.2Mn-0.12Cu-0.7Fe-0.5Si alloy, which are not randomly distributed, FIG. 1B. It is noted that the Fe and Si concentrations are still within the allowance range of a standard AA3003 alloy. In other words, Al-1.2Mn-0.12Cu-0.7Fe-0.5Si alloy is classified as AA3003, based on the American Aluminum (AA) standard. It is very interesting that these two Al—Mn-based alloys (with and without Fe and Si) have a distinct difference in their precipitate structure, which leads to different mechanical properties. Two populations of nano-precipitates, hexagonal α-Al(Mn,Fe)Si and $L1_2$-structured $Al_3Zr$ nano-precipitates, were mainly observed in the Al-1.2Mn-0.12Cu-0.7Fe-0.5Si-0.3Zr-0.1Sn wt. % alloy, FIGS. 1C and 1D. A very high number density from both of these of precipitate types is observed, which leads to the highest strength as well as creep resistance at elevated temperatures.

Figure 2A:
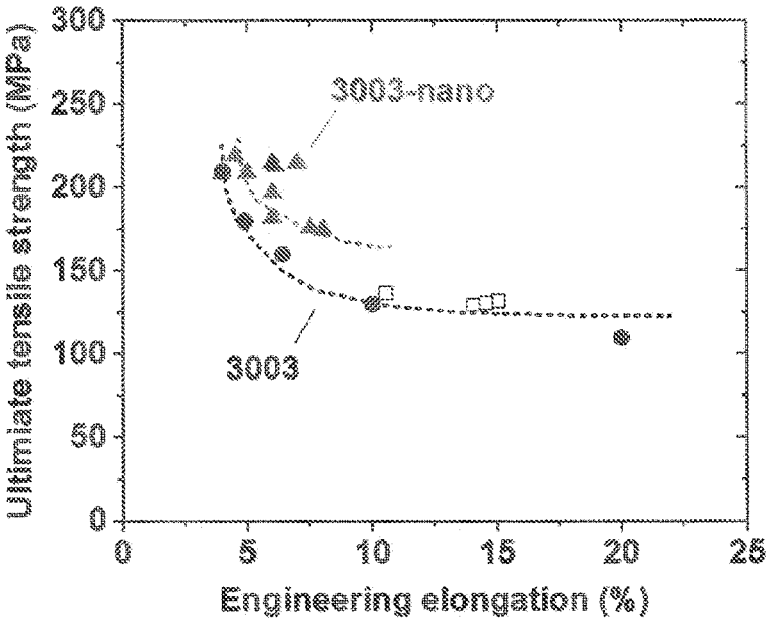
FIGS. 2A and 2B: (A) Tensile strength versus elongation of the AA3003 alloy from the literature (●), and two alloys: Al-1.2Mn-0.12Cu-0.7Fe-0.5Si wt. % (a), and Al-1.2Mn-0.12Cu-0.7Fe-0.5Si-0.3Zr-0.1Sn wt % (invented alloy) (▲) with the existence of $Al_3Zr$ nano-precipitates, and (B) Microhardness of cold rolled Al-1.2Mn wt. % (Al—Mn) and Al-1.2Mn-0.2Si-0.3Zr-0.1Sn wt. % (Al—Mn-nano) (invented alloy) alloys versus annealing temperature (1 h at each temperature).

FIG. 2A displays ultimate tensile strength (UTS) versus engineering elongation of tensile specimens of Al-1.2Mn-0.12Cu-0.7Fe-0.5Si wt. % and Al-1.2Mn-0.12Cu-0.7Fe-0.5Si-0.3Zr-0.1Sn wt. %, which were heat-treated to different conditions. Literature data for AA3003, having different tempers, is also plotted for comparison. A common trade-off of strength and ductility behavior is observed for both alloys. The Al-1.2Mn-0.12Cu-0.7Fe-0.5Si-0.3Zr-0.1Sn alloy achieves a better combination of strength and ductility, compared to the other. For example, at an elongation of 8%, the UTS is ~130 MPa for AA3003 and ~175 MPa for Al-1.2Mn-0.12Cu-0.7Fe-0.5Si-0.3Zr-0.1Sn (the AA3003 alloy containing $Al_3Zr$ nano-precipitates), which represents a 35% increase in strength.

Figure 2B:
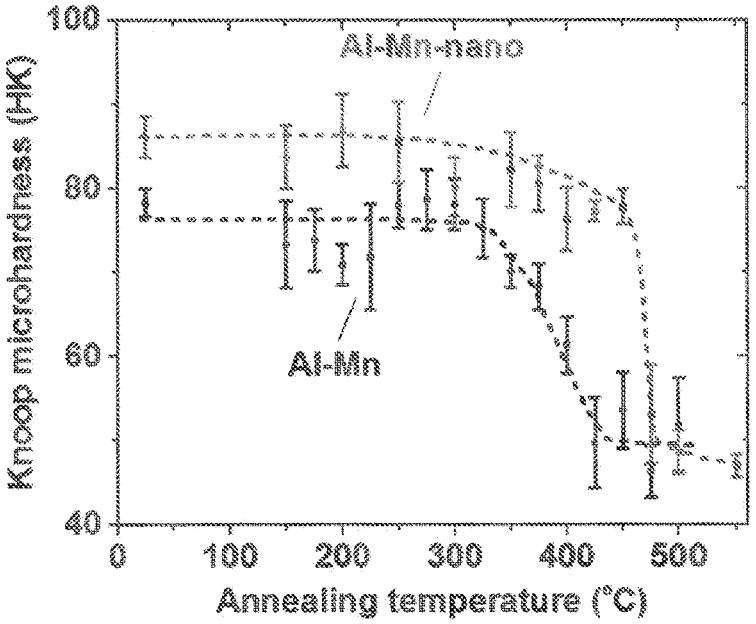

FIG. 2B displays microhardnesses as a function of annealing temperature of rolled sheets from peak-aged Al—Mn samples, with and without the existence of the $Al_3Zr$ nano-precipitates, i.e., Al-1.2Mn wt. % and Al-1.2Mn-0.2Si-0.3Zr-0.1Sn wt. % alloys, respectively. This plot indicates the recrystallization temperature, when textured, cold-worked grains generated by the rolling process recrystallize, grow and coarsen, which softens the material. It is apparent from FIG. 2B that the recrystallization temperature is at ~350° C. for Al—Mn, and at ~460° C. for Al—Mn alloy containing nano-precipitates (an increase of 110° C.). This suggests that the $Al_3Zr$ nano-precipitate suppresses the recrystallization, by pinning the movement of grain boundaries via Zener pinning. This enhancement in recrystallization resistance is highly beneficial for manufacturing high-strength AA3003 sheets and foils, as the sheet-rolling process typically occurs at elevated temperatures (i.e., via hot rolling), so that dynamic recrystallization occurs and strain hardening is not effective. Now that the new alloy shows a recrystallization temperature increased to 460° C., strain hardening can become active, thereby adding strength to the final rolled sheets and foils.

Figure 3:
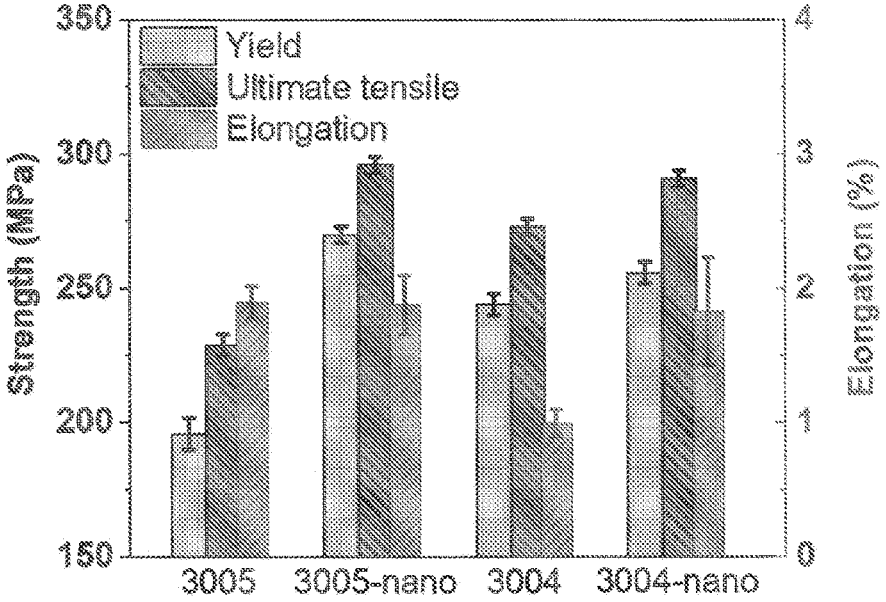
FIG. 3: Mechanical properties of peak-aged and rolled Al-1.2Mn-1.0Mg-0.4Fe-0.3Si-0.3Zr-0.1Sn wt. % (3004-nano) (invented alloy) and Al-1.2Mn-0.4Mg-0.7Fe-0.5Si-0.3Zr-0.1Sn wt. % (3005-nano) (invented alloy), compared to Al-1.2Mn-1.0Mg-0.1Si wt. % (3004) and Al-1.2Mn-0.4Mg-0.2Si wt. % (3005) thin sheets (300 μm thickness).

Mechanical properties of peak-aged and rolled AA3004-nano and AA3005-nano, with addition of $Al_3Zr$ nano-precipitates, compared to the commercial AA3004 and AA3005 thin sheets are displayed in FIG. 3. Both AA3004 and AA3005 contain additional magnesium, whereas AA3003 is essentially free of magnesium. Strength of both AA3004-nano and AA3005-nano is increased, while ductility is the same or better, as compared to the commercial AA3004 and AA3005 alloys. Very significant increases of 38% in yield strength and 29% in tensile strength for AA3005 and of 5% in yield strength and 7% in tensile strength for AA3004 were observed. The result from AA3005-nano alloy is very promising for an effort to thin aluminum can bodies.

FIG. 4 displays steady-state tensile creep rate as a function of applied stress of α-Al matrix, Al-1.2Mn wt. %, Al-1.2Mn-0.12Cu-0.7Fe-0.5Si wt. %, and Al-1.2Mn-0.12Cu-0.7Fe-0.5Si-0.3Zr-0.1Sn alloys wt. % (invented alloy). The creep temperature is very high for aluminum alloys: 400° C., i.e. 72% of the melting temperature (on the Kelvin scale). This figure indicates that Al-1.2Mn-0.12Cu-0.7Fe-0.5Si-0.3Zr-0.1Sn has a dramatically improved creep resistance as compared to the other two alloys, for strain rates above $10^{-7}$ $s^{-1}$. Threshold stresses, below which no observable creep is detected, exist in all three alloys. The values are ~15 MPa for Al-1.2Mn wt. % and ~0.22 MPa for both Al-1.2Mn-0.12Cu-0.7Fe-0.5Si wt. % and Al-1.2Mn-0.12Cu-0.7Fe-0.5Si-0.3Zr-0.1Sn wt. % alloys. The drastic creep resistance improvement of Al-1.2Mn-0.12Cu-0.7Fe-0.5Si wt. % alloy, with addition of $Al_3Zr$ nano-precipitates, translates into a strain rate about four orders of magnitude slower under an applied stress of 28 MPa (this corresponds to accumulating the same strain in 1 h vs. ~400 days). Thus, the alloy shows strong improvements of thermal stability and durability of an AA3003 alloy, due to the addition of $Al_3Zr$ nano-precipitates.

FIG. 5 displays mechanical strength at a very high temperature (400° C.) for Al-1.2Mn-0.12Cu-0.7Fe-0.5Si-0.3Zr-0.1Sn wt. %, as compared to commercial 2000-series aluminum alloys that are currently utilized in elevated temperatures, such as engine blocks and pistons. Both yield and tensile strength of the Al-1.2Mn-0.12Cu-0.7Fe-0.5Si- 0.3Zr-0.1Sn wt. % invented alloy is about double that of the 2000-series aluminum alloys. This very high strength at such an elevated temperature presents a huge potential application for automotive and aerospace components, which require lightweight and excellent high-temperature performance. Nevertheless, the cost of AA3003-nano is much lower than the 2000-series aluminum alloys (~$0.6/lb compared to ~$1.0/lb, respectively) mainly because AA3003-nano can be fabricated utilizing recycled beverage cans.

FIG. 6 displays tensile strength versus elongation at break of Al-1.0Mn-1.0Mg-0.15Cu-0.5Fe-0.2Si wt. % (AA3004) (example alloy), and Al-1.0Mn-1.0Mg-0.15Cu-0.5Fe-0.2Si-0.3Zr-0.1Sn wt. % (AA3004-nano) (invented alloy), fabricated by the following steps: casting, hot-rolling, cold-rolling, and heat aging treatment at temperatures in the range of about 350° C. to about 450° C. for times in the range of about 2 to about 24 hours. For the sample elongation at break, AA3004-nano alloy achieves about 20-30 MPa in tensile strength higher compared to the AA3004 alloy. For the same tensile strength, AA3004-nano alloy achieves about 0.02-0.03 higher in elongation at break. These improvements are the result of the presence of $Al_3Zr$ nano-precipitates, generated from the presence of Zr and Sn in the alloy and through the above-mentioned processing steps.

Table 1 lists mechanical properties for thin sheets (0.25 mm in thickness) of Al-1.0Mn-1.0Mg-0.15Cu-0.5Fe-0.2Si wt. % (AA3004) (example alloy 1), Al-1.0Mn-1.0Mg-0.15Cu-0.5Fe-0.2Si-0.3Zr-0.1Sn wt. % (AA3004-nano) (invented alloy 1), Al-0.85Mn-2.0Mg-0.17Cu-0.52Fc-0.24Si wt. % (UBC) (example alloy 2), and Al-0.85Mn-2.0Mg-0.17Cu-0.52Fe-0.24Si-0.3Zr-0.1Sn wt. % (UBC-nano) (invented alloy 2). AA3004 is a common aluminum alloy for beverage can bodies. The AA3004-nano alloy (invented alloy 1) achieves higher yield strength and tensile strength, while maintaining essentially the same elongation at break, compared to the AA3004 alloy (example alloy 1). UBC is an alloy that is produced by re-melting used beverage cans (UBC). Typically, the chemical composition of UBC is Al-0.85Mn-2.0Mg-0.17Cu-0.52Fe-0.24Si wt. %. After adding Zr and Sn to form $Al_3Zr$ nano-precipitates, UBC-nano (invented alloy 2) achieves higher yield strength and tensile strength, while maintaining essentially the same elongation at break, compared to the UBC alloy (example alloy 2). Due to utilizing recycled used beverage cans, the material cost of both UBC and UBC-nano alloys is much lower than the regular 3000-series aluminum alloys utilized in beverage cans. The thin sheets of the alloys of Table 1 were fabricated by the following steps: casting, hot-rolling, annealing, cold-rolling, and stabilizing heat treatment.

TABLE 1

| | Yield strength (MPa) | Tensile strength (MPa) | Elongation at break (%) |
|---|---|---|---|
| AA3004 (example alloy 1) | 309 ± 7 | 329 ± 10 | 3-5 |
| AA3004-nano (invented alloy 1) | 336 ± 6 | 366 ± 5 | 3-5 |
| UBC (example alloy 2) | 338 ± 7 | 370 ± 5 | 4-6 |
| UBC-nano (invented alloy 2) | 376 ± 4 | 400 ± 4 | 4-6 |

In one embodiment, an aluminum alloy comprises aluminum, manganese, zirconium, and an inoculant, and includes a nanoscale precipitate comprising $Al_3Zr$, wherein the nanoscale precipitate has an average diameter of about 20 nm or less and has an $L1_2$ structure in an α-Al face centered cubic matrix, wherein the average number density of the nanoscale precipitate is about $20^{21}$ $m^{-3}$ or more, and wherein the inoculant comprises tin.

In one embodiment, an aluminum alloy possesses a yield strength of at least about 40 MPa at a temperature of 400° C.

In one embodiment, a creep rate of an aluminum alloy is less than about $10^{-2}$ per second under an applied stress of 25 MPa and at a temperature of 400° C.

In one embodiment, an aluminum alloy comprises about 0.8 to about 1.5% by weight manganese; about 0.2 to about 0.5% by weight zirconium; about 0.01 to about 0.2% by weight tin; and aluminum as the remainder.

In one embodiment, an aluminum alloy comprises about 0.05 to about 0.7% by weight iron; about 0.05 to about 0.6% by weight silicon; about 0.8 to about 1.5% by weight manganese; about 0.2 to about 0.5% by weight zirconium; about 0.01 to about 0.2% by weight tin; and aluminum as the remainder.

In one embodiment, an aluminum alloy comprises about 0.05 to about 0.7% by weight iron; about 0.05 to about 0.6% by weight silicon; about 0.8 to about 1.5% by weight manganese; about 0.2 to about 0.5% by weight zirconium; about 0.01 to about 0.2% by weight tin; about 0.05 to about 0.2% by weight copper; and aluminum as the remainder.

In one embodiment, an aluminum alloy comprises about 0.2% by weight silicon, about 1.2% by weight manganese, about 0.3% by weight zirconium, about 0.1% by weight tin, and aluminum as the remainder.

In one embodiment, an aluminum alloy comprises about 0.12% by weight copper, about 0.7% by weight iron, about 0.5% by weight silicon; about 1.2% by weight manganese, about 0.3% by weight zirconium, about 0.1% by weight tin, and aluminum as the remainder.

In one embodiment, an aluminum alloy comprises aluminum, manganese, magnesium, silicon, zirconium, and an inoculant, and includes a nanoscale precipitate comprising $Al_3Zr$, wherein the nanoscale precipitate has an average diameter of about 20 nm or less and has an $L1_2$ structure in an α-Al face centered cubic matrix, wherein the average number density of the nanoscale precipitate is about $20^{21}$ $m^{-3}$ or more, and wherein the inoculant comprises one or more of tin, strontium, zinc, gallium, germanium, arsenic, indium, antimony, lead, and bismuth.

In one embodiment, if an aluminum alloy is in hard-temper, it possesses a yield strength of at least about 330 MPa, a tensile strength of at least about 360 MPa, and an elongation of at least about 3% at room temperature.

In one embodiment; if an aluminum alloy is in soft-temper, it possesses a tensile strength of at least about 230 MPa, and an elongation of at least about 10% at room temperature.

In one embodiment, an aluminum alloy comprises about 0.05 to about 0.7% by weight iron; about 0.05 to about 0.6% by weight silicon; about 0.05 to about 3.0% by weight magnesium; about 0.8 to about 1.5% by weight manganese; about 0.2 to about 0.5% by weight zirconium; about 0.01 to about 0.2% by weight tin; and aluminum as the remainder.

In one embodiment, an aluminum alloy comprises about 0.05 to about 0.2% by weight copper; about 0.05 to about 0.7% by weight iron; about 0.05 to about 0.6% by weight silicon; about 0.05 to about 3.0% by weight magnesium; about 0.8 to about 1.5% by weight manganese; about 0.2 to about 0.5% by weight zirconium; about 0.01 to about 0.2% by weight tin; and aluminum as the remainder In one embodiment, if an aluminum alloy is in hard-temper, the alloy possesses a yield strength of at least about 370 MPa, a tensile strength of at least about 395 MPa, and an elongation of at least about 4% at room temperature.

In one embodiment, an aluminum alloy comprises a plurality of $L1_2$ precipitates having an average diameter of about 10 nm or less.

In one embodiment, an aluminum alloy comprises a plurality of $L1_2$ precipitates having an average diameter of about 3 nm to about 7 nm.

In one embodiment, an aluminum alloy comprises about 0.4% by weight magnesium, about 0.7% by weight iron, about 0.5% by weight silicon, about 1.2% by weight manganese, about 0.3% by weight zirconium, about 0.1% by weight tin, and aluminum as the remainder.

In one embodiment, an aluminum alloy comprises about 1.0% by weight magnesium, about 0.4% by weight iron, about 0.3% by weight silicon, about 1.2% by weight manganese, about 0.3% by weight zirconium, about 0.1% by weight tin, and aluminum as the remainder.

In one embodiment, an aluminum alloy comprises about 0.15% by weight copper, about 1.0% by weight magnesium, about 0.5% by weight iron, about 0.2% by weight silicon, about 1.0% by weight manganese, about 0.3% by weight zirconium, about 0.1% by weight tin, and aluminum as the remainder.

In one embodiment, an aluminum alloy comprises about 0.17% by weight copper, about 2.0% by weight magnesium, about 0.52% by weight iron, about 0.24% by weight silicon, about 0.85% by weight manganese, about 0.3% by weight zirconium, about 0.1% by weight tin, and aluminum as the remainder.

In some embodiments, at least 70% (in some embodiments at least 80%, in some embodiments at least 90%, and in some embodiments at least 95%) of an aluminum alloy is recycled from used aluminum cans.

The disclosed aluminum alloys are essentially free of scandium, which is understood to mean that no scandium is added intentionally. Addition of scandium in aluminum alloys is advantageous for mechanical properties. For example, it is described in U.S. Pat. No. 5,620,652, which is incorporated herein by reference. However, scandium is very expensive (ten times more expensive than silver), severely limiting its practical applications.

Zirconium, with a concentration of up to about 0.3 wt %, is sometimes added to aluminum alloys for grain refining. The refined grain structure helps improve castability, ductility, and workability of the final product. An example is described in U.S. Pat. No. 5,976,278, which is incorporated herein by reference. In the present application, zirconium, with a concentration of less than about 0.5 wt. %, and preferably less than about 0.4 wt. %, is added together with an inoculant element to form $Al_3Zr$ nano-precipitates, wherein the nanoscale precipitate has an average diameter of about 20 nm or less and has an $L1_2$ structure in an $\alpha$-Al face centered cubic matrix, and wherein the average number density of the nanoscale precipitate is about $20^{21}$ $m^{-3}$ or more, with a purpose to improve mechanical strength, ductility, creep resistance, thermal stability and durability of the based alloys. Generally, a zirconium concentration of more than about 0.2 wt. % is needed so that Zr atoms have enough driving force to form $Al_3Zr$ nano-precipitates.

Disclosed aluminum alloys comprise an inoculant, wherein the inoculant comprises one or more of tin, strontium, zinc, gallium, germanium, arsenic, indium, antimony, lead, and bismuth. Presence of an inoculant accelerates precipitation kinetics of $Al_3Zr$ nano-precipitates, thus these precipitates can be f within a practical amount of time during heat-treatment. In the other words, the beneficial $Al_3Zr$ nano-precipitates can be formed within a few hours of heat treatment, with the presence of the inoculant, compared to a few weeks or months of heat treatment, without the presence of an inoculant. Among all inoculant elements, tin appears to be the best performer in terms of accelerating precipitation kinetics of $Al_3Zr$ nano-precipitates. A tin concentration of less than about 0.2% is needed for the mentioned purpose. Beyond this value, tin will form bubbles and/or a liquid phase in the aluminum solid matrix, which is detrimental for the mechanical properties. This behavior is described in U.S. Pat. No. 9,453,272, which is incorporated herein by reference.

One method for manufacturing a component from a disclosed aluminum alloy comprises: a) melting the alloy at a temperature of about 700 to 900° C.; h) then casting the alloy into casting molds at ambient temperature; c) then using a cooling medium to cool the cast ingot; and d) then heat aging the cast ingot at a temperature of about 350° C. to about 450° C. for a time of about 2 to about 48 hours. In one embodiment, the method further comprises cold rolling the cast ingot to form a sheet product. In one embodiment, the method further comprises the final stabilizing heat treatment of the sheet product at a temperature of about 140° C. to about 170° C. for a time of about 1 to about 5 hours. In some embodiments, the cooling medium can be air, water, ice, or dry ice. The heat aging step stated above (350-450° C. for 2-48 hours) is determined to be peak-aging for components comprising the disclosed aluminum alloys. When a component manufactured from a disclosed aluminum alloy is peak-aged, the microstructure of the component is thermally stable and is unchanged by exposure to elevated temperatures for extended times.

Another method for manufacturing a component from a disclosed aluminum alloy comprises: a) melting the alloy at a temperature of about 700 to 900° C.; b) then casting the alloy into casting molds at ambient temperature; c) then using a cooling medium to cool the cast ingot; and d) then hot rolling the alloy into a sheet. In one embodiment, the method further comprises then heat aging the sheet at a temperature of about 350° C. to about 450° C. for a time of about 2 to about 48 hours. In one embodiment, the method further comprises then cold rolling the sheet, after the heat aging step, to form a thin sheet or foil product. In one embodiment, the method further comprises a final stabilizing heat treatment of the thin sheet or foil product at a temperature of about 140° C. to about 170° C. for a time of about 1 to about 5 hours.

Another method for manufacturing a component from a disclosed aluminum alloy comprises: a) melting the alloy at a temperature of about 700 to 900° C.; b) then casting the alloy into casting molds at ambient temperature; c) then using a cooling medium to cool the cast ingot; d) then hot rolling the alloy into a sheet; e) then cold rolling the sheet to form a thin sheet or foil product; f) then heat aging the thin sheet or foil product at a temperature of about 350° C. to about 450° C. for a time of about 2 to about 24 hours.

Some applications for the disclosed alloys include, for example, beverage cans, aerosol cans, roofing materials, siding materials, chemical manufacturing equipment, food manufacturing equipment, storage tanks, pressure vessels, home appliances, kitchenware, sheet-metal work, truck parts, trailer parts, automotive parts, and heat exchangers. Some fabricated forms of the disclosed aluminum alloys include, for example, wires, sheets, plates and foils.

From the foregoing, it will be understood that numerous modifications and variations can be effectuated without departing from the true spirit and scope of the novel concepts of the present invention. It is to be understood that no limitation with respect to the specific embodiments illustrated and described is intended or should be inferred.

The invention claimed is:

1. A 3000-series aluminum alloy comprising:
about 0.8 to about 1.5% by weight manganese;
about 0.2 to about 0.5% by weight zirconium;
about 0.05 to about 0.6% by weight silicon;
about 0.01 to about 0.2% by weight tin as an inoculant;
optionally, about 0.05 to about 3.0% by weight magnesium;
optionally, about 0.05 to about 0.7% by weight iron;
optionally, about 0.05 to about 0.2% by weight copper;
less than 0.05% by weight of any additional impurity; and
aluminum as the remainder;
wherein the alloy includes a nanoscale precipitate comprising $Al_3Zr$;
wherein the nanoscale precipitate has an average diameter of about 20 nm or less and has an $L1_2$ structure in an α-Al face centered cubic matrix; and
wherein the average number density of the nanoscale precipitate is about $10^{21}$ $m^{-3}$ or more.

2. The aluminum alloy of claim 1, comprising:
about 0.05 to about 0.7% by weight iron.

3. The aluminum alloy of claim 2, comprising about 0.05 to about 0.2% by weight copper.

4. The aluminum alloy of claim 2, comprising about 0.2% by weight silicon, about 1.2% by weight manganese, about 0.3% by weight zirconium, about 0.1% by weight tin, and aluminum as the remainder.

5. The aluminum alloy of claim 3, comprising about 0.12% by weight copper, about 0.7% by weight iron, about 0.5% by weight silicon, about 1.2% by weight manganese, about 0.3% by weight zirconium, about 0.1% by weight tin, and aluminum as the remainder.

6. The aluminum alloy of claim 1, wherein the alloy possesses a yield strength of at least about 40 MPa at a temperature of 400° C.; and has a creep rate that is less than about $10^{-7}$ per second under an applied stress of 25 MPa and at a temperature of 400° C.

7. The aluminum alloy of claim 1, comprising:
about 0.05 to about 3.0% by weight magnesium.

8. The aluminum alloy of claim 7, comprising:
about 0.05 to about 0.7% by weight iron.

9. The aluminum alloy of claim 8, comprising about 0.05 to about 0.2% by weight copper.

10. The aluminum alloy of claim 1, wherein the plurality of $L1_2$ precipitates has an average diameter of about 10 nm or less.

11. The aluminum alloy of claim 1, wherein the plurality of $L1_2$ precipitates has an average diameter of about 3 nm to about 7 nm.

12. The aluminum alloy of claim 1, wherein: (a) if the aluminum alloy is in hard-temper, the alloy possesses a yield strength of at least about 330 MPa, a tensile strength of at least about 360 MPa, and an elongation of at least about 3% at room temperature; (b) if the aluminum alloy is in soft-temper, the alloy possesses a tensile strength of at least about 230 MPa, and an elongation of at least about 10% at room temperature.

13. The aluminum alloy of claim 8, comprising about 0.7% by weight iron, about 1.2% by weight manganese, 0.4% by weight magnesium, about 0.5% by weight silicon, about 0.3% by weight zirconium, about 0.1% by weight tin, and aluminum as the remainder.

14. The aluminum alloy of claim 8, comprising about 0.4% by weight iron, about 1.2% by weight manganese, 1.0% by weight magnesium, about 0.3% by weight silicon, about 0.3% by weight zirconium, about 0.1% by weight tin, and aluminum as the remainder.

15. The aluminum alloy of claim 9, comprising about 0.15% by weight copper, about 0.5% by weight iron, about 1.0% by weight manganese, about 1.0% by weight magnesium, about 0.2% by weight silicon, about 0.3% by weight zirconium, about 0.1% by weight tin, and aluminum as the remainder.

16. The aluminum alloy of claim 9, comprising about 0.17% by weight copper, about 0.52% by weight iron, about 0.85% by weight manganese, about 2.0% by weight magnesium, about 0.24% by weight silicon, about 0.3% by weight zirconium, about 0.1% by weight tin, and aluminum as the remainder.

17. The aluminum alloy of claim 1, wherein the alloy is essentially free of scandium.

18. The aluminum alloy of claim 1, wherein at least about 70% of the alloy is recycled from used aluminum cans.

19. The aluminum alloy of claim 1, wherein at least about 80% of the alloy is recycled from used aluminum cans.

20. The aluminum alloy of claim 1, wherein at least about 90% of the alloy is recycled from used aluminum cans.

21. The aluminum alloy of claim 1, wherein at least about 95% of the alloy is recycled from used aluminum cans.

22. A method for manufacturing a component from the aluminum alloy of claim 1, the method comprising:
a) melting the alloy at a temperature of about 700° C. to about 900° C.;
b) casting the alloy into casting molds at ambient temperature;
c) using a cooling medium to cool the cast ingot; and
d) heat aging the cast ingot at a temperature about 350° C. to about 450° C. for a time of about 2 hours to about 48 hours.

23. The method of claim 22, further comprising cold rolling the cast ingot to form a sheet product.

24. The method of claim 23, further comprising stabilization heat treating the sheet product at a temperature of about 140° C. to about 170° C. for a time of about 1 to about 5 hours.

25. A method for manufacturing a component from the aluminum alloy of claim 1, the method comprising:
a) melting the alloy at a temperature of about 700° C. to about 900° C.;
b) casting the alloy into casting molds at ambient temperature;
c) using a cooling medium to cool the cast ingot; and
d) hot rolling the cast ingot to form a sheet.

26. The method of claim 25, further comprising heat aging the sheet at a temperature of about 350° C. to about 450° C. for a time of about 2 hours to about 48 hours.

27. The method of claim 26, further comprising cold rolling the sheet, after the heat aging step, to form a thin sheet or foil product.

28. The method of claim 27, further comprising stabilization heat treating the thin sheet or foil product at a temperature of about 140° C. to about 170° C. for a time of about 1 to about 5 hours.

29. The method of claim 25, further comprising
e) cold rolling the sheet to form a thin sheet or foil product; and
f) heat aging the thin sheet or foil product at a temperature of about 350° C. to about 450° C. for a time of about 2 hours to about 24 hours.

30. A beverage can comprising the aluminum alloy of claim 1.

31. An aerosol can comprising the aluminum alloy of claim 1.

32. An aluminum alloy component comprising the aluminum alloy of claim 1, wherein the aluminum alloy component is selected from a group consisting of roofing materials, siding materials, chemical manufacturing equipment, food manufacturing equipment, storage tanks, pressure vessels, home appliances, kitchenware, sheet-metal work materials, truck parts, trailer parts, automotive parts, and heat exchangers.

33. A fabricated form of the aluminum alloy of claim 1, the fabricated form selected from a group consisting of wires, sheets, plates and foils.

* * * * *